United States Patent [19]

Roberts

[11] 4,383,204

[45] May 10, 1983

[54] THREE-LEVEL INTERFACE CONTROL CIRCUIT FOR ELECTRONICALLY BALLASTED LAMP

[75] Inventor: Victor D. Roberts, Burnt Hills, N.Y.

[73] Assignee: General Electric Company, Schenectady, N.Y.

[21] Appl. No.: 242,779

[22] Filed: Mar. 11, 1981

[51] Int. Cl.[3] ..... H05B 37/02; H05B 41/36

[52] U.S. Cl. ..... 315/291; 315/52; 315/58; 315/200 R; 315/DIG. 4; 307/31; 323/354

[58] Field of Search ..... 323/354; 307/12, 15, 307/31, 98, 130, 257, 264, 321; 315/291, 224, 200 R, 52, 53, 58, 71, DIG. 4

[56] References Cited

U.S. PATENT DOCUMENTS 4,178,535 12/1979 Miller ..... 315/53

4,346,332 8/1982 Walden ..... 315/307

*Primary Examiner*—Eugene La Roche

*Assistant Examiner*—Vincent Deluca

*Attorney, Agent, or Firm*—Geoffrey H. Krauss; James C. Davis, Jr.; Marvin Snyder

[57] ABSTRACT

An interface control circuit for use with a standard three-way, four-switch-position lamp socket to allow a fluorescent lamp-electronic ballast combination to be controlled to provide a selected one of four light output levels, utilizes a three-input, full-wave bridge rectifier to provide ballast/lamp operating potential and gating elements and associated level-setting circuitry to provide at least one D.C. voltage output having an amplitude dependent upon the set position of the socket switch and utilized to control the ballast to set the light output of the associated lamp to a selected one of three different levels when the ballast/lamp combination is energized.

18 Claims, 5 Drawing Figures

THREE-LEVEL INTERFACE CONTROL CIRCUIT FOR ELECTRONICALLY BALLASTED LAMP

BACKGROUND OF THE INVENTION

The present invention relates to lighting control circuitry and more particularly to a novel control circuit for providing power and control voltages to an electronic ballast/lamp combination from a standard three-way socket to control the lamp light output level.

In this age of energy conservation, it is particular desirable to provide light sources producing luminous output equivalent to that of a standard incandescent bulb, at a reduced input from the electrical power mains. It is known that electronically-ballasted discharge lamps can be utilized to replace the relatively inefficient incandescent lamp. Of particular advantage is the "dimmable", or variable output, electronic ballast-/discharge lamp combination described and claimed in co-pending U.S. patent applications Ser. No. 177,835, abandoned and Ser. No. 177,942, U.S. Pat. No. 4,346,332 both of which applications were filed Aug. 14, 1980, assigned to the assignee of the present application and incorporated herein in their entirety by reference. Briefly, the luminous output level of this ballast-/lamp combination is variably responsive to the magnitude of an impedance between, or of a current shunted from, a pair of input control terminals. Additional input circuitry may be utilized to provide the shunting current, as well as a ballast/lamp on/off signal, responsive to the magnitude of a single D.C. control voltage, as described and claimed in co-pending U.S. patent application Ser. No. 242,782 filed on even date herewith, now U.S. Pat. No. 4,345,200, issued Aug. 17, 1982, assigned to the assignee of the present invention and also incorporated herein in its entirety by reference.

It is desirable to provide energy-efficient circuitry for allowing such an input-control/ballast/lamp combination to replace a standard "three-way" incandescent bulb, whereby the energy-efficient ballast/lamp combination can be mounted in a standard three-way socket, which previously accepted a three-way incandescent lamp, and which ballast/lamp combination is itself controlled by application of A.C. power to either, or both, of the "ring" and "button" contacts of the standard three-way socket to provide a selected one (e.g. off, dim, medium and high) of a plurality of lighting levels.

It is known to provide dimmer controls directly connected to the ballast, whereby replacement of an incandescent bulb with such a ballast/lamp combination requires that both the existing three-way switch and the ballast dimmer control be operated to vary the light output level; the socket switch merely provides an on/-off switching action (such as by connecting the A.C. input contact of the ballast only to a single one of the ring and button contacts) while control of the actual light level, once the lamp has been switched to the on condition, is by action of the separate level control on the ballast package. This arrangement is extremely inconvenient for the consumer and is also relatively costly and of relatively low reliability. Accordingly, a control circuit which may be utilized between the standard three-way socket and the input of a control/ballast/lamp combination, to provide a plurality of lamp luminous output levels selected solely by the action of the three-way socket switch, is highly desirable.

BRIEF SUMMARY OF THE INVENTION

In accordance with the invention, a control circuit for providing at least one output having an amplitude selected by the position of a three-way switching means and also providing D.C. operating potential to a subsequent ballast/lamp combination, from a A.C. source, utilizes a three-input full-wave bridge circuit for providing the operating potential when either of two selectable hot input leads are coupled to the A.C. source. Unidirectionally-conductive elements are connected to each of the pair of switch-selectable hot inputs to gate output circuitry providing three preselected output levels for controlling the subsequent ballast/lamp combination to an associated one of three non-zero luminous output levels.

In a preferred embodiment the three-wire bridge rectifier utilizes a pair of like-poled rectifiers between each of the positive and negative outputs thereof and each of the first and second switched hot inputs and the input return, from the A.C. source, whereby the bridge rectifier provides D.C. output potential as long as either one of the ring and button contacts of the socket is energized.

In presently preferred embodiments, a unidirectional-conducting element is connected from each associated one of the pair of switch-selected hot input terminals to either the output of an associated voltage divider section, to provide D.C. voltage outputs at each of preselected different levels, or to the input of a subcircuit controlling the level at a single output terminal to a selective one of a plurality of preselected levels.

Accordingly, it is an object of the present invention to provide a control circuit for energizing and controlling the output of an associated control/ballast/lamp combination to that one of a plurality of luminous output levels selected by a multiple-position switch.

This and other objects of the present invention will become apparent upon consideration of the following detailed description, when considered in conjunction with the drawings.

DETAILED DESCRIPTION OF THE INVENTION

Figure 1:
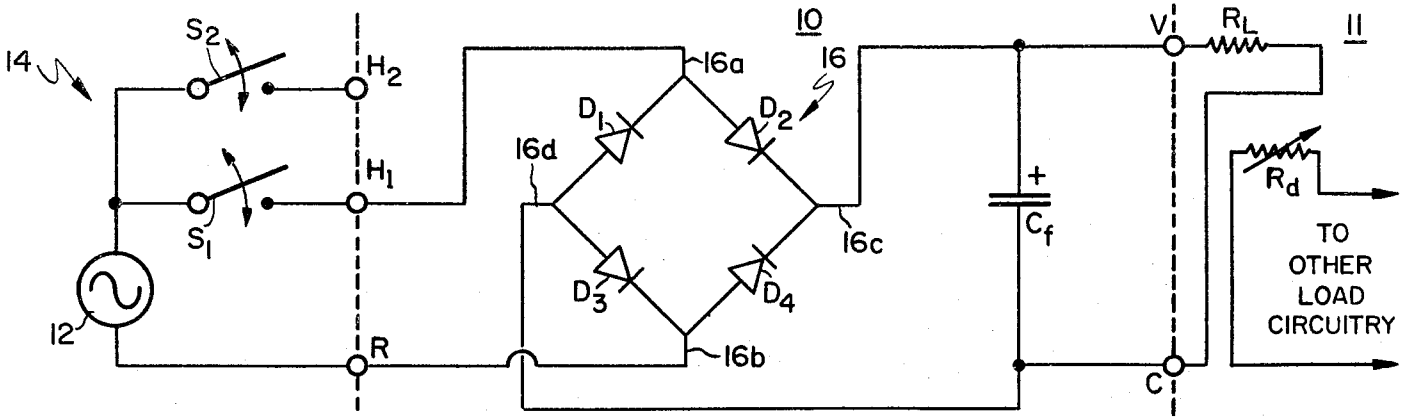
Fig. 1 (PRIOR ART)
FIG. 1 is a schematic diagram of a prior art circuit for providing operating potential to an electronic ballast-lamp utilized with a three-way socket.

Referring initially to FIG. 1, a prior art circuit 10 interfaces between an electronic ballast represented by load 11 and an A.C. source 12 with a "three-way" lamp switch means 14. The three-way switch means 14 may be schematically considered as a pair of switches $S_1$ and $S_2$, each having a first terminal thereof connected to one side of source 12 and having a remaining terminal connected to an associated one of socket switch terminals $H_1$ and $H_2$, commonly referred to as the "ring" and "button" contacts. As is well-known, the socket switching arrangement is such that from an initial "off" position, in which both of switches $S_1$ and $S_2$ are open-circuited (and wherein neither hot contact $H_1$ nor $H_2$ is connected to the source) sequential actuation of the physical switch progresses through closure of switch means $S_1$ only (with switch means $S_2$ open-circuited, whereby only contact $H_1$ is connected to the source), in the "dim" condition, to closure of switch means $S_2$ only (with switch means $S_1$ open-circuited, whereby only contact $H_2$ is connected to the source), in the "medium" condition, to closure of both switch means $S_1$ and $S_2$ (with both of contacts $H_1$ and $H_2$ being connected to the source) in the "high" condition, before the switch returns to the "off" position with both of switch means $S_1$ and $S_2$ in the open-circuited condition. Previously, the A.C. inputs 16*a* and 16*b*, of a bridge rectifier 16 in control section 10, were respectively connected to the first hot contact $H_1$ and to the return R, or "shell", contact of the socket, whereby the source potential appeared between bridge inputs 16*a* and 16*b* only when switch means $S_1$ was closed. The bridge rectifier, comprised of diodes $D_1$–$D_4$, is utilized with a filter capacitance $C_f$, connected between the bridge positive output 16*c* and negative output 16*d*, to provide a desired D.C. operating voltage to the ballast 11 equivalent resistance $R_L$ connected between the control section common C terminal and output voltage V terminal. A dimming control $R_d$ is connected to internal circuitry in the load (ballast) and is physically mounted thereon. Thus, the prior art control section essentially operates to provide power to the ballast/lamp combination at alternate positions of the three-way switch, exactly as if one filament, of a two-filament, three-way incandescent bulb, were burned-out; the lamp level must be set by the independent dimming resistance $R_d$, whereby two separate actions are required to select a desired light output level. Even if the input control/ballast/lamp combination described and claimed in the aforementioned patent applications is utilized, the prior art socket-load interface circuit 10 does not provide a control signal responsive to actuation of the three-way socket switch, whereby the lamp will always be operated at a fixed (e.g. maximum) output level.

Figure 2:
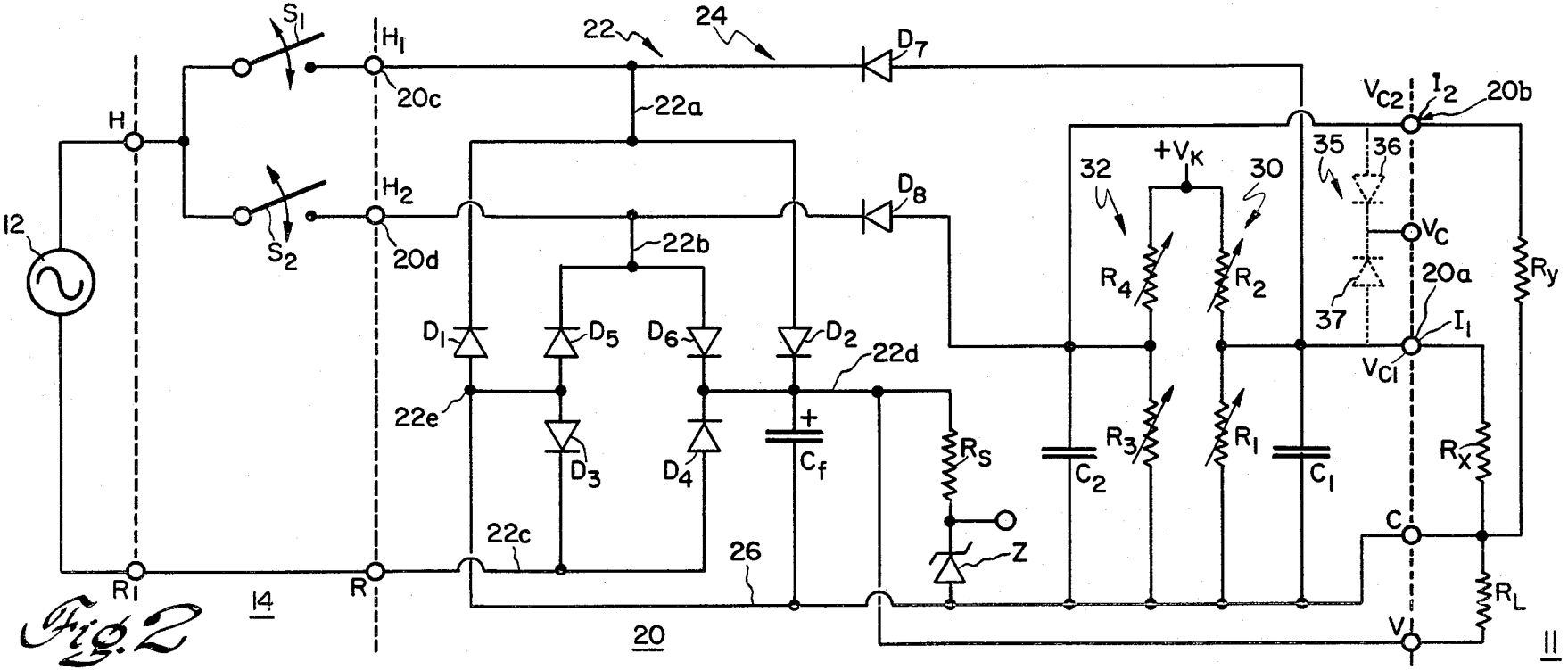
FIG. 2 is a schematic diagram of one presently preferred embodiment of a multiple-output level-selection circuit utilized with a three-way socket, in accordance with the principles of the present invention.

Referring now to FIG. 2, a first presently preferred embodiment of my novel interface control circuit 20 is connected between three-way switching socket 14 and a load ballast 11. The load ballast not only represents a power-consuming load resistance $R_L$, connected between the interface common C terminal and the D.C. output voltage V terminal, but also has at least one input for establishing the lamp output level responsive to the level of a voltage thereat; illustratively, load 11 as a pair of input terminals $I_1$ and $I_2$, each appearing as a load resistance on an associated one of interface circuit level-control outputs 20*a* and 20*b* (e.g. equivalent input resistances $R_x$ and $R_y$, with respect to common terminal C). Common C is usually not, in the time domain, at the same potential as source return R.

In accordance with the invention, interface control circuit 20 includes a three-input bridge rectifier subcircuit 22 and a load-output-control subcircuit 24 for providing output control voltages $V_{C1}$ and $V_{C2}$ to load control input terminals $I_1$ and $I_2$, respectively. Rectifier means 22 comprises a full-wave bridge rectifier having a first hotline input 22*a*, connected to a first control circuit hot input terminal 20*c*, and a second bridge rectifier hot input 22*b* connected to a second control circuit hot input terminal 20*d*. Hot input terminals 20*c* and 20*d* are respectively connected to the ring and button electrodes H1 and H2 of socket means 14 for selective energization responsive to closure of the associated switch means $S_1$ and $S_2$. The third bridge rectifier input 22*c* is connected to the socket return R, or shell, contact which is carried through socket means 14 to the return R terminal of source 12, opposite to the hot H terminal thereof.

Rectifier means 22 includes 6 unidirectionally-conducting elements $D_1$–$D_6$, which may be semiconductor diodes and the like. Diodes $D_1$–$D_4$ form a bridge rectifier between first hot input 22*a* and return input 22*c* providing a positive potential at bridge output 22*d*, with respect to a second bridge output 22*e*, connected to the interface control circuit common line 26. A pair of diodes $D_5$ and $D_6$ are connected between second hot input 22*b* and the associated positive and negative bridge outputs 22*d* and 22*e*, and are poled identical with the poling of diodes $D_1$ and $D_2$, respectively. Diodes $D_3$–$D_6$ form another bridge rectifier.

In operation, load power supply subsection 22 provides the required load operating potential across filter capacitor $C_f$, when either of control circuit inputs 20*c* or 20*d* is energized by closure of the associated switch means $S_1$ or $S_2$. Thus, in the "off" condition, neither switch means of socket 14 is closed and potential is not applied to control circuit 20, or to the subsequent input control/ballast/lamp combination. When the switch of socket 14 is actuated to the "dim" condition, switch means $S_1$ is closed and connects first bridge hot input 22*a* to the hot source terminal H. Bridge return 22*c* is connected to the source return terminal R. Diodes $D_1$ and $D_4$ conduct during negative polarity half-cycles, and diodes $D_2$ and $D_3$ conduct during positive-polarity half-cycles, of the source waveform to provide a full-wave-rectified waveform to the filter capacitor $C_f$, whereby a D.C. operating potential is supplied to load resistance $R_L$. In the "medium" switch condition, switch means $S_2$ is closed, connecting second hot line input 22*b* of the bridge to source hot terminal H. Diodes $D_3$ and $D_6$ conduct for positive-polarity half-cycles, and diodes $D_4$ and $D_5$ conduct for negative-polarity half-cycles, of the source waveform, providing operating potential for the subsequent load. In the "high" switch condition, both of switch means $S_1$ and $S_2$ are closed, applying the source potential to both of bridge hot inputs 22*a* and 22*b*. As the magnitude of the source waveform applied to each hot input 22*a* and 22*b* is equal, diodes $D_2$ and $D_6$ conduct during positive-polarity half-cycles, in addition to diode $D_3$, while diodes $D_1$ and $D_5$ both conduct, in addition to diode $D_4$, during the negative-polarity half-cycles. Accordingly, supply subcircuit 22 supplies an operating potential of substantially constant magnitude to load resistance $R_L$, when source 12 is connected between bridge return 22*c* and either or both of circuit hot inputs 20*c* and 20*d*, responsive to the action of the socket switch means.

Load-output level-setting subcircuit 24 includes a pair of gating elements, such as diodes $D_7$ and $D_8$ each having a cathode electrode connected to one of interface control circuit hot input terminals 20*c* and 20*d*. The anode of each of the gating diodes is connected to an associated one of first and second interface control circuit control voltage outputs 20*a* and 20*b*, respectively. A first output level-setting voltage-divider 30 includes a first resistance element $R_1$ connected between common line 26 and first output 20*a*, and a second resistance element $R_2$ connected between output 20*a* and a source of substantially constant voltage ($+V_K$). A first filter capacitance $C_1$ is connected in parallel with first resistance element $R_1$. A second output-level-setting voltage-divider 32 includes a resistance element $R_3$ between common line 26 and second output terminal 20*b*, and another resistance element $R_4$ between output 20*b* and the source of $+V_K$ voltage. A filter capacitance $C_2$ is connected in parallel with resistance element $R_3$. It should be understood that the voltage-divider potential $V_K$ may be provided either by circuitry in the load ballast 11, or may be provided from the voltage across power supply subsection filtering capacitance $C_f$; in the latter case, voltage $V_K$ may be taken at the output of a voltage-divider, or, as illustrated, from the anode of a zener diode Z connected in series with a series current-setting resistance $R_s$, across filter capacitance $C_f$.

In operation, when the socket switch is in the "off" condition, with both switch means $S_1$ and $S_2$ open-circuited, no operating potential appears across capacitance $C_f$ and voltage $V_K$ is substantially zero, as are the voltages at control outputs 20*a* and 20*b*. In the "dim" condition with switch means $S_1$ closed, diodes $D_1$, $D_4$ and $D_7$ are forward biased and diodes $D_2$, $D_3$, $D_5$, $D_6$ and $D_8$ are reversed-biased, during negative-polarity half-cycles. As diode $D_1$ and $D_7$ are both conducting, the first output voltage $V_{C1}$ has an amplitude of approximately zero volts, with respect to common line 26. As diode $D_8$ is reversed-biased, control voltage $V_{C2}$ rises to a value determined by the magnitude of supply voltage $V_K$ and by the voltage division ratio of second voltage-divider 32. During the positive-polarity half-cycle of the source (at input 20*c* with respect to common line 26) diodes $D_2$ and $D_3$ conduct, and the remainder of the diodes are reversed biased. As diode $D_7$ is reversed-biased, control voltage $V_{C1}$ begins rising, with a time constant determined by the capacitance of capacitor $C_1$ and the equivalent resistance of the parallel combination of resistance elements $R_1$ and $R_2$, to the voltage determined by the magnitude of supply voltage $V_K$ and the ratio of voltage-divider 30. If this time constant is much greater than the duration of a half-cycle of the source waveform, e.g. time constant greater than about $8\frac{1}{3}$ milliseconds, control voltage $V_{C1}$ will remain near zero magnitude. Therefore, when power is applied between first hot input 20*c* and return R, with second hot input 20*d* open-circuited, control voltage $V_{C1}$ will be held near zero volts and control voltage $V_{C2}$ will rise to a predetermined value set by the values of second voltage-divider 32 resistance elements $R_3$ and $R_4$ (and load resistance $R_y$).

It will be seen that when the socket switch means is actuated to the "medium" condition, with switch means $S_2$ closed and switch means $S_1$ open, the reverse situation occurs; second control voltage $V_{C2}$ is held near zero volts and first control voltage $V_{C1}$ rises to a predetermined value, established by the magnitude of source voltage $V_K$ and the voltage-divider 30 ratio established by resistance elements $R_1$ and $R_2$ (and load resistance $R_x$). Further, in the "high" output condition, with both of switch means $S_1$ and $S_2$ closed, both first and second output voltages $V_{C1}$ and $V_{C2}$ are held at a low level to provide maximum output, as useful with the ballast input control circuit of aforementioned application Ser. No. 242,782. It should be understood that the amplitude of each of the output control voltages $V_{C1}$ and $V_{C2}$ may be set by the proper selection of the value of fixed resistances $R_1$–$R_4$, or by providing one (or both) of the resistance elements of each voltage-dividers 30 and 32 as variable resistances (as shown by the broken-line variable resistance arrows). It should also be understood that, if load resistance $R_x$ and $R_y$ are of the same order of magnitude of (or less than) the resistance of the associated one of $R_1$ or $R_3$, then $R_x$ or $R_y$ will affect the voltage divider ratio and/or time constant. Further, where the load input control circuitry presents a substantially constant load resistance (e.g. load resistances $R_x$ and $R_y$ at interface control circuit output terminals 20*a* and 20*b*, respectively), resistance elements $R_1$ and $R_3$ may be removed, and the voltage-dividers respectively formed by the connection of resistance element $R_2$ and load control resistance $R_x$ or by resistance element $R_4$ and load input resistance $R_y$. Further, it should be understood that, if the controlled load includes only a single control input terminal for receiving a single control voltage $V_C$, suitable means may be provided, such as the OR-gate 35, shown in broken lines, utilizing a pair of gating diodes 36 and 37, and the like.

Figure 2A:
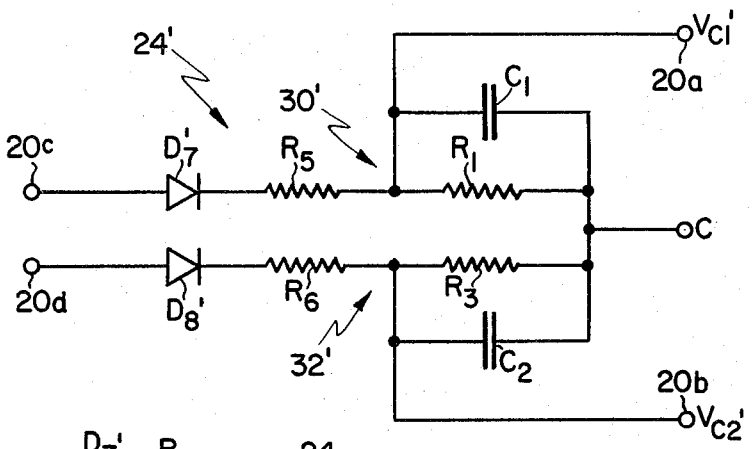
FIGS. 2*a* and 2*b* are schematic diagrams of portions of other presently preferred embodiments for providing a plurality of output levels selected by the switch positions of a three-way socket switch, in accordance with the principles of the present invention.

Referring now to FIG. 2*a*, control voltage subcircuit 24' may be provided with "positive" logic by connecting the anodes of diodes $D_7'$ and $D_8'$ to the associated one of interface control circuit inputs 20*c* and 20*d*. In this presently preferred embodiment, a source of potential $V_K$ is not required. Diode $D_7'$ is in series with a resistance $R_5$, forming first voltage-divider 30' with resistance element $R_1$, while diode $D_8'$ is in series with another resistance element $R_6$, forming second voltage-divider 32' in conjunction with resistance element $R_3$.

In operation, in the "off" condition, neither input 20*c* nor input 20*d* is energized and the control output voltages $V_{C1}'$ and $V_{C2}'$, at respective outputs 20*a* and 20*b*, are substantially at zero volts, by connection of associated resistance elements $R_1$ and $R_3$ to interface control circuit common C. In the "dim" condition, only input 20*c* is energized, whereby diode $D_7'$ conducts during the positive-polarity half-cycle and is reversed-biased during the negative-polarity half-cycle, while diode $D_8'$ is always reversed-biased. Thus, during the positive-polarity source waveform half-cycle, diode $D_7$ rectifies the source voltage; that D.C. voltage, after amplitude reduction by first voltage-divider 30', charges capacitance $C_1$ to a positive output voltage $V_{C1}'$, with respect to common line C. In the "medium" output condition, only input 20*d* is energized, whereby diode $D_8'$ rectifies the source waveform positive-polarity half-cycle and, after amplitude reduction by second voltage-divider 32', charges capacitance, $C_2$ to another output voltage $V_{C2}'$ magnitude. In the "high" output condition, both of inputs 20*c* and 20*d* are enabled, whereby both of diodes $D_7'$ and $D_8'$ conduct, providing positive D.C. voltages $V_{C1}'$ and $V_{C2}'$ at respective outputs 20*a* and 20*b*. It will be seen that, by proper selection of the values of $R_1$, $R_3$, $R_5$ and $R_6$, the required positive-polarity D.C. control output voltages $V_{C1}'$ and $V_{C2}'$ can be provided. In manner similar to that discussed with respect to the circuitry of FIG. 2, capacitors $C_1$ and $C_2$ are used to maintain the associated output voltages during negative-polarity half-cycles when diodes $D_7$, and $D_8$, are both reversed-biased; resistance elements $R_1$ and/or $R_3$ may be provided by the input resistances of the subsequent load input control section, and suitable means may be utilized to provide control voltages for a load having a single control input terminal.

Figure 2B:
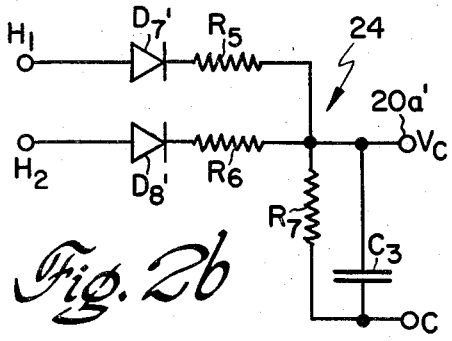

Referring now to FIG. 2*b*, if the subsequent load requires a single interface control circuit output voltage $V_C$, with respect to a common C terminal, the circuit of FIG. 2*a* may be modified by connection of the terminals of resistances $R_5$ and $R_6$, furtherest from diodes $D_7'$ and $D_8'$, to the single output terminal 20*a*'. Another resistance element $R_7$ is connected between output 20*a* and common C, and is paralleled by a filter capacitance $C_3$. In operation, in the "dim" and "medium" conditions, one of diodes $D_7'$ and $D_8'$ conduct, whereby the magnitude of single output voltage $V_C$ is set by the resistance of the associated resistance element, respectively $R_5$ and $R_6$, in conjunction with resistance $R_7$. In the "high" condition both diodes conduct, whereby the output amplitude is established by the magnitude of the equivalent resistance of $R_5$ and $R_6$ in parallel, forming a voltage-divider with resistance $R_7$. It should be understood that resistance element $R_7$ may be the input resistance of the subsequent, controlled circuitry, if such resistance is substantially constant. Capacitance $C_3$ is chosen to provide a time-constant selected as described with respect to FIG. 2.

Figure 2C:
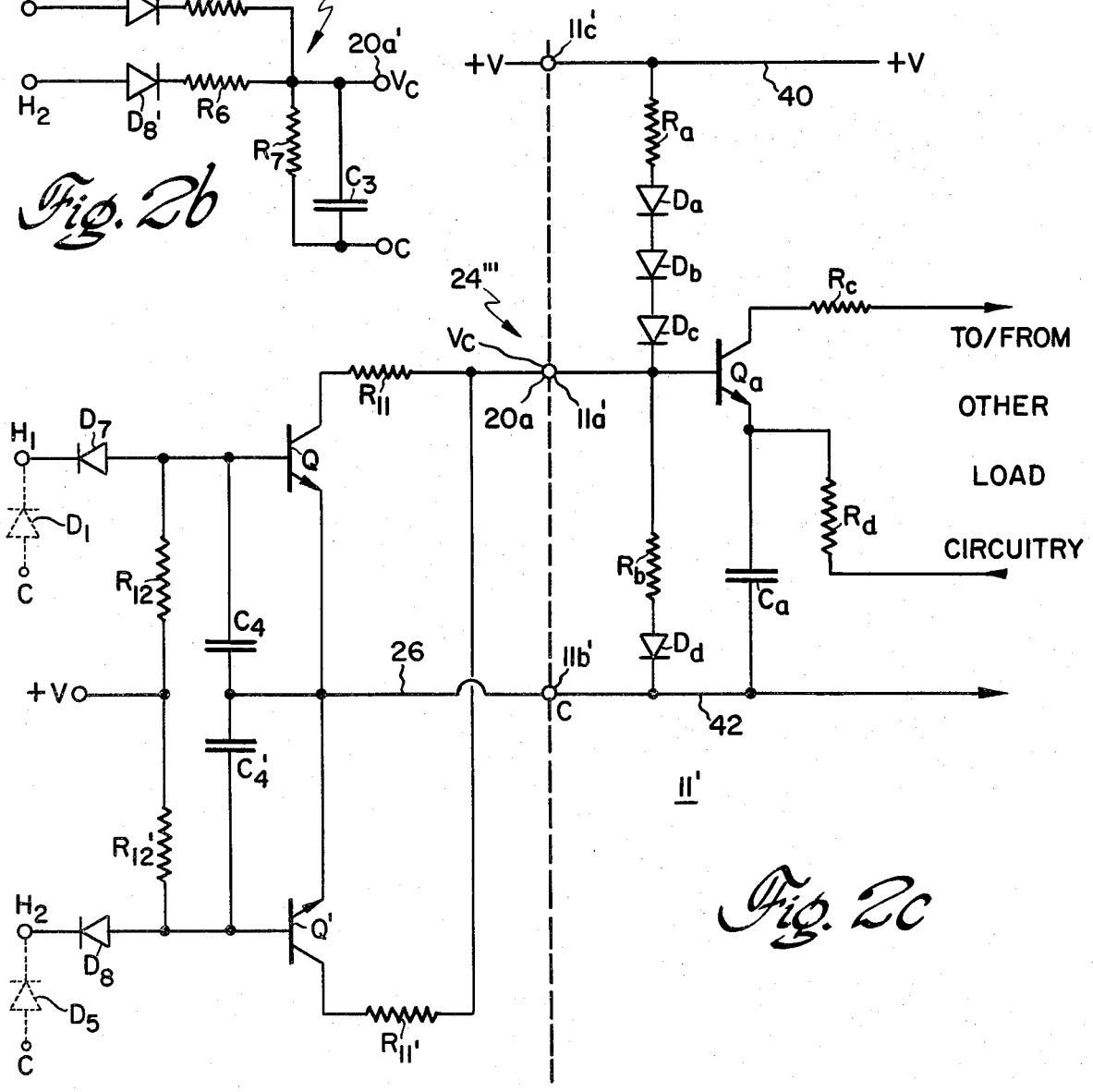
FIG. 2*c* is a schematic diagram of a portion of a load ballast/lamp circuit and of another presently preferred control subcircuit, in accordance with the principles of the present invention, for providing a control output having a selected one of a plurality of levels thereat in accordance with the position of a multiple-position socket switch.

Referring now to FIG. 2*c*, another presently preferred output level-setting circuit 24''' has a single output 20*a*, at which a single control voltage $V_C$ is provided, with respect to interface control common C. The level-setting-subcircuit is utilized with a load ballast 11' having: a control input 11*a*' coupled to interface control circuit output 20*a*; a common terminal 11*b*' coupled to interface control circuit common terminal C; and another terminal 11*c*' at which is provided a D.C. operating potential of magnitude of +V coupling into interface control subcircuit 24'''. By way of illustration only, the input circuitry of ballast 11' may comprise a control transistor $Q_a$ having its base electrode connected to ballast input 11*a*' and connected to the positive +V voltage bus 40 through a first resistance $R_a$ in series with a chain of series-connected compensation diodes $D_a$, $D_b$ and $D_c$, biased in the normally-forward-conducting direction. Another resistance element $R_b$ is in series connection with an additional compensation diode $D_d$, between the base electrode of transistor $Q_a$ and ballast common line 42. The transistor collector electrode is in series with a collector-resistance $R_c$, to other load circuitry. The transistor emitter electrode is connected to common line 42 by a capacitor element $C_a$. The emitter, through a resistance $R_d$, receives a voltage derived from the ballast output operating the associated lamp. As the emitter voltage is related to the power applied to the lamp, and as the transistor collector signal is switched when the emitter voltage thereof rises to within 0.6 volts of the voltage at the transistor $Q_a$ base voltage, e.g. the voltage at input 11*a*', transistor $Q_a$ will be caused to switch at different values of load power and therefore vary the magnitude of power delivered to the lamp and the light output emitted therefrom.

Level control subcircuit 24''' utilizes gating diodes $D_7$ and $D_8$, each having a cathode electrode connected to an associated one of the first and second interface control circuit hot input terminals 20*c* and 20*d*. The anode of each diode is connected to the base electrode of an associated transistor Q or Q', respectively. The emitter electrodes of both transistors are connected to interface control circuit common line 26. A capacitance element $C_4$ or $C_4'$ is connected from the common line 26 to the base electrode of each of associated transistors Q and Q'. A resistance element $R_{11}$ or $R_{11}'$ is connected in series with the collector electrode of each of associated transistor Q and Q' to a common connection at the interface control circuit level-setting output terminal 20*a*. A base resistor $R_{12}$ or $R_{12}'$ is connected from the base of the associated transistor Q or Q' to receive the positive +V voltage provided at terminal 11*c*' of the load.

In operation, the voltage at the load control transistor $Q_a$ base is varied by connecting an additional level-setting resistance (e.g. one of resistances $R_{11}$ or $R_{11}'$) between the base electrode and ballast common, to vary the switching point of ballast control transistor $Q_a$. When the socket switch is in the "off" position, neither first nor second hot inputs 20*c* and 20*d* receive source voltage, whereby both of diodes $D_7$ and $D_8$ and associated transistors Q and Q' are off (since ballast 11' does not receive power from bridge rectifier section 22 and so cannot provide a voltage on bus 40). In all of the "on" conditions (dim, medium and high output) the positive +V voltage is available at bus 40 and is applied to the transistors Q and Q' via base resistances $R_{12}$ and $R_{12}'$. One, or both, of source terminals $H_1$ and $H_2$ received the source A.C. waveform. During a negative-polarity source waveform half-cycle, that one of diodes $D_7$ and/or $D_8$ connected to a terminal receiving the source waveform conduct, and the voltage at the base electrode at the associated transistor Q or Q', respectively, is clamped to the common C line by action of the associated one of power supply subcircuit diodes $D_1$ and/or $D_5$ (as shown in broken line); the associated transistor therefore has a substantially zero base-emitter voltage and is in the cut-off condition. During a positive-polarity source waveform half-cycle, the diodes $D_7$ and $D_8$ are reverse-biased and the base electrode voltage is held, if the associated diode conducted during the previous negative-polarity half-cycle, to substantially zero magnitude by the time constant of the associated base capacitance $C_4$ or $C_4'$, and base resistance $R_{12}$ or $R_{12}'$; this time constant is relatively greater than the half-cycle time interval of the source waveform. However, if one of terminals $H_1$ and/or $H_2$ does not receive the source waveform, the associated base capacitance charges through the associated base resistance toward voltage +V, until that transistor is placed in saturation, connecting the associated collector resistance from output 20*a* through the common C line. Thus, in the "dim" condition, the source waveform is applied to first hot input terminal $H_1$ and a substantially zero voltage results at the base electrode of transistor Q, by the above-discussed sequence. Transistor Q is thus turned off, while transistor Q' remains saturated by application of +V thereto via resistor $R_{12}'$. Accordingly, the collector resistance $R_{11}'$, associated with transistor Q', is effectively connected between the load ballast common line 42 and the control transistor base input 11*a*', decreasing the voltage at the base of transistor $Q_a$ by a first value and causing the ballast control transistor $Q_a$ to switch at a lower emitter voltage, thereby controlling the associated lamp output power to a first level, e.g. one-fourth of the maximum lamp output. In the "medium" condition, the source waveform is applied to second hot input terminal $H_2$; diode $D_8$ conducts (as does diode $D_5$) to provide a substantially zero voltage at the base of transistor Q', placing that transistor in the cut-off condition. As first hot terminal $H_1$ does not receive a source waveform, transistor Q receives a positive base voltage, via resistance element $R_{12}$, sufficient to saturate transistor Q. Thus, resistance $R_{11}'$ is effectively removed from between the common lines 26 and 42 and the load control input terminal 11*a*′, while the saturated transistor Q connects resistance element $R_{11}$ therebetween. The magnitude of $R_{11}$ is chosen to reduce the base voltage of transistor $Q_a$ to another level, whereby the control transistor $Q_a$ switches at an emitter voltage which is lower than the "high" condition emitter voltage, but greater than the "dim" condition emitter voltage, whereby the associated lamp is controlled to an intermediate, e.g. one-half of maximum, power output setting. When the socket switch is actuated to the "high" condition, both first and second hot contacts $H_1$ and $H_2$ receive the source waveform, whereby substantially zero voltages are provided at the base electrodes of each transistors Q and Q′. These transistors are then both in the cut-off condition, whereby both resistance elements $R_{11}$ and $R_{11}'$ are effectively removed from connection between the control transistor $Q_a$ base electrode and ballast common line 42. The base voltage accordingly rises to the value set by the base circuit resistance elements $R_a$ and $R_b$ and diodes $D_a$–$D_d$, whereby control transistors $Q_a$ conducts at an emitter voltage higher than the emitter voltage required for conduction in the "dim" or "medium" conditions. Accordingly, the controlled lamp provides a relatively high output power, which may be set by adjustment of one of resistance elements $R_a$ or $R_b$. It should be understood that other desired ratios may be implemented by suitable choice of magnitudes of resistor elements $R_{11}$ and $R_{11}'$, in conjunction with the preselected magnitudes of resistance elements $R_a$ and $R_b$.

While several presently preferred embodiments of my novel interface control circuit for variable-output electronic ballast/lamp combination have been presented herein, many variations and modifications will now become apparent to those skilled in the art. It is my intent, therefore, to be limited only by the scope of the appending claims and not by the details provided for the selected circuits described herein.

What is claimed is:

1. An interface control circuit for use with a three-way lamp socket, having a four-position switch means settable to off, dim, medium and high positions, for providing separate power and control potentials to separate power and control input terminals of a dimmable electronic ballast-lamp load from an A.C. source, comprising:

a power supply subcircuit for supplying operating potential to said load power input terminals when said switch means is set at each one of said dim, medium and high positions; and a load level-setting subcircuit for supplying a selected one of three different level-setting potentials to said load control input terminals, each different potential being supplied responsive to said switch means being set at a different one of said dim, medium and high positions.

2. The circuit of claim 1, wherein said power supply subcircuit provides a D.C. operating potential to said load input terminals.

3. The circuit of claim 2, wherein said socket switch means has first and second contacts selectively connectable to a first terminal of said source; and said power supply subcircuit comprises: means having first and second inputs each connected to one of said switch means first and second contacts, and a return input coupled to a remaining terminal of said source, for rectifying the A.C. potential of said source when at least one of said first and second contacts are connected to said source; and an impedance element for filtering the rectified A.C. source potential from said rectifier means to supply D.C. operating potential to said load power input terminals.

4. The circuit of said claim 3, wherein said rectifier means comprises: a positive output lead; a negative output lead; first and second unidirectionally-conducting elements coupled between said positive output lead and each of said first and second inputs and poled to conduct during positive-polarity half-cycles of the waveform of said source; third and fourth unidirectionally-conducting elements coupled between said negative output lead and each of said first and second inputs and poled to conducted during a negative-polarity half-cycle of said source waveform; and fifth and sixth unidirectionally-conducting elements coupled between the remaining terminal of said source and a respective one of said positive and negative output leads and poled to conduct respectively during said negative-polarity and said positive-polarity source waveform half-cycles.

5. The circuit of claim 4, wherein said first through sixth unidirectionally-conducting elements are semiconductor diodes.

6. The circuit of claim 3, wherein said impedance element is an electrical capacitance.

7. An interface control circuit for use with a three-way lamp socket, having a four-position switch means settable to off, dim, medium and high positions for selectably connecting first and second contacts of said socket to a first terminal of a source for providing power and control potentials to power and control input terminals at first and second control input terminals and a common line of a dimmable electronic ballast-lamp load from an A.C. source, comprising;

a power supply subcircuit for supplying operating potential to said load power input terminals when said switch means is set at each one of said dim, medium and high positions; and a load level-setting subcircuit for supplying a selected one of three different level-setting potentials to said load control input terminals, each different potential being supplied responsive to said switch means being set at a different one of said dim, medium and high positions, said level-setting subcircuit including first and second unidirectionally-conducting elements respectively connected between one of said first and second contacts and an associated one of said first and second load control input terminals; a subcircuit common line connected to said load common line; first and second resistance elements each coupled between said common line and an associated one of said first and second load control input terminals; first and second filter capacitance elements each coupled in parallel with an associated one of said first and second resistance elements; and means coupled to said first and second load control input terminals and operating in conjunction with said first and second unidirectionally-conducting elements and said first and second resistance elements and filter capacitances for providing said different level-setting potentials at said first and second load control input terminals responsive to the energization conditions of said first and second contacts.

8. The circuit of claim 7, wherein said level-setting potential providing means comprises: a source of substantially constant operating potential; and third and fourth resistance elements each coupled between said operating potential source and an associated one of said first and second load control input terminals, the value of said first through fourth resistance elements being selected to provide preselected magnitudes of said level-setting potential at said first and second load control input terminals during operation of said level-setting subcircuit.

9. The circuit of claim 8, wherein at least one of said first through fourth resistance elements is a variable resistance element.

10. The circuit of claim 8, wherein said operating potential source comprises a resistance element and a zener diode in series connection with said resistance element for receiving the operating potential supplied by said power supply subcircuit, said substantially constant operating potential being provided across said zener diode.

11. The circuit of claim 7, wherein said level-setting means comprises third and fourth resistances each in series connection between an associated one of first and second unidirectionally-conducting elements and the associated one of the first and second load control input terminals, the resistance magnitudes of said first through fourth resistance elements being predeterminately selected to provide predetermined values of level-setting potential at said first and second load control input terminals responsive to the energization conditions of said first and second contacts.

12. The circuit of claim 11, wherein at least one of said first through fourth resistance elements is a variable resistance element.

13. The circuit of claim 7, wherein at least one of the first and second resistance elements are provided by an input resistance between the associated load control input terminal and common line.

14. An interface control circuit for use with a three-way lamp socket, having a four-position switch means settable to off, dim, medium and high positions for selectably connecting first and second contacts of said socket to a first terminal of a source for providing power and control potentials to power and control input terminals at a single control input terminal and a common line of a dimmable electronic ballast-lamp load from an A.C. source, comprising;

a power supply subcircuit for supplying operating potential to said load power input terminals when said switch means is set at each one of said dim, medium and high positions; and a load level-setting subcircuit for supplying a selected one of three different level-setting potentials to said load control input terminals, each different potential being supplied responsive to said switch means being set at a different one of said dim, medium and high positions, said level-setting subcircuit including first and second unidirectionally-conducting elements and the associated one of the first and second load control input terminals, the resistance magnitudes of said first through fourth resistance elements being predeterminately selected to provide predetermined values of level-setting potential at said first and second load control input terminals responsive to the energization conditions of said first and second contacts.

15. The circuit of claim 14, wherein said level-setting potential providing means includes a first resistance element connected between said load control input terminal and said common line; a filter capacitance connected across said first resistance element; and second and third resistance elements each in series connection between an associated one of said first and second unidirectionally-conducting elements and said load control input terminal; the values of said first, second, and third resistance element being preselected to provide preselected magnitudes of said level-setting potential at said load control input terminal during operation of said level-setting subcircuit.

16. The circuit of claim 15, wherein at least one of said first, second, and third resistance elements is a variable resistance element.

17. The circuit of claim 14, wherein said first resistance element is provided by an input resistance between the load control input terminal and common line.

18. The circuit of claim 14, wherein said level-setting potential providing means comprises: a source of substantially constant operating potential; first and second transistors, each having an emitter electrode connected to said common line, a base electrode connected to the second lead of an associated one of said first and second unidirectionally-conducting elements, and a collector electrode; first and second base resistance elements connected between said operating potential source and the base electrode of an associated one of the first and second transistors; first and second filter capacitances respectively connected between the base electrode of an associated one of said first and second transistors and said common line; and first and second collector resistances connected between the collector electrode of an associated one of said first and second transistors and said load control input terminal; each said base resistor having a value preselected to saturate the associated transistor and cause the associated collector resistance to be connected between said load control input terminal and said common line when the associated one of said unidirectionally-conducting elements is not connected to said source, and each said transistor being placed in the cut-off condition when the associated one of said unidirectionally-conducting elements is connected to said source via an associated one of said contacts.

* * * * *